US007334986B2

(12) United States Patent
Sohn et al.

(10) Patent No.: US 7,334,986 B2
(45) Date of Patent: Feb. 26, 2008

(54) CENTRIFUGAL FAN

(75) Inventors: Sang Bum Sohn, Seoul (KR); Sung Bae Song, Kyungki-do (KR); Ho Seon Rew, Seoul (KR)

(73) Assignee: LG Electronics Inc., Seoul (KR)

( * ) Notice: Subject to any disclaimer, the term of this patent is extended or adjusted under 35 U.S.C. 154(b) by 154 days.

(21) Appl. No.: 10/979,319

(22) Filed: Nov. 3, 2004

(65) Prior Publication Data

US 2005/0281669 A1 Dec. 22, 2005

(30) Foreign Application Priority Data

Jun. 16, 2004 (KR) ..... 10-2004-0044634

(51) Int. Cl.
*F01D 1/02* (2006.01)

(52) U.S. Cl. ..... 415/204; 415/206

(58) Field of Classification Search ..... 415/203, 415/206, 207

See application file for complete search history.

(56) References Cited

U.S. PATENT DOCUMENTS 801,304 A * 10/1905 Davidson ..... 415/204
1,319,364 A * 10/1919 Skillins et al. ..... 406/101
2,243,585 A * 5/1941 Towler et al. ..... 210/392
4,419,049 A * 12/1983 Gerboth et al. ..... 415/212.1
4,681,508 A * 7/1987 Kim ..... 415/116
5,813,834 A * 9/1998 Hopfensperger et al. ... 415/206
6,273,679 B1 * 8/2001 Na ..... 415/204
2004/0018083 A1 1/2004 Sohn et al.

* cited by examiner

*Primary Examiner*—Edward K. Look
*Assistant Examiner*—Devin Hanan
(74) *Attorney, Agent, or Firm*—Greenblum & Bernstein, P.L.C.

(57) ABSTRACT

A centrifugal fan, in which an expansion angle of a radius of curvature of the outer periphery of a scroll housing from a position angle of a cutoff portion, serving as a suction portion, to a designated portion from the former in the direction of air flow is gradually decreased; and an expansion angle of the radius of curvature of the outer periphery of the scroll housing from the above designated portion to a discharge portion is gradually increased, thereby easily converting the velocity of the discharged fluid to pressure due to the increased dimensions of the discharge region and increasing the flow rate. Further, since noise generated from a cutoff portion of the centrifugal fan of the present invention maintains the same level as that of the conventional centrifugal fan, the centrifugal fan of the present invention has reduced noise at the same flow rate.

6 Claims, 7 Drawing Sheets

CENTRIFUGAL FAN

BACKGROUND OF THE INVENTION

1. Field of the Invention

The present invention relates to a centrifugal fan, and more particularly to a centrifugal fan, an expansion angle of which varies without increasing the overall width of a scroll housing, thereby improving blowing capacity and reducing noise.

2. Description of the Related Art

Generally, a centrifugal fan for emitting heat, which is referred to as a "sirocco fan", is widely used by household electric appliances including an LCD projector. As shown in FIG. 1, the centrifugal fan comprises an impeller 11 rotated by a motor, and a scroll housing 12 for guiding air inhaled by the impeller 11 to an outlet 12*b* to discharge the air to the outside.

The impeller 11 includes a rib 11*b*, and a plurality of blades 11*a* supported by the rib 11*b*, and is connected to an actuating unit of the motor. The scroll housing 12 is designed such that air is inhaled thereinto through an inlet 12*a* formed through the front surface thereof by the guide of a bell mouth 13, and is then discharged to the outside through the outlet 12*b* along a path expanded from a cutoff portion. That is, when the impeller 11 connected to the actuating unit is rotated, air is inhaled into the scroll housing 12 through the inlet 12*a*, travels along the gradually expanded path of the scroll housing 12, and is discharged to the outside through the outlet 12*b*.

Here, since noise and flow rate generated from the centrifugal fan 10 are varied according to the design of the scroll housing 12, a design of the scroll housing having low noise and high flow rate has been developed.

In FIG. 1, $\theta_0$ represents a reference angle of a portion where a curved surface forming the outer periphery of the scroll housing 50 is finished, $\theta_c$ represents a position angle of the cutoff portion (C), and $\theta_x$ represents an angle of rotation of the impeller 11 from the reference angle ($\theta_0$) in a counterclockwise direction.

FIG. 2 is a graph illustrating an expansion angle of a conventional centrifugal fan, a scroll housing of which is designed using an Archimedean scroll curve. FIG. 3 is a schematic front view of the conventional centrifugal fan, the scroll housing of which is designed using the Archimedean scroll curve. FIG. 4 is a graph illustrating an expansion angle of another conventional centrifugal fan, a scroll housing of which is designed using an exponential scroll curve.

As shown in FIGS. 2 and 4, the scrolling housings 12 of the conventional centrifugal fans are divided into two types, i.e., one type which is designed using the Archimedean scroll curve (A) and the other type which is designed using the exponential scroll curve (B).

First, with reference to FIGS. 2 and 3, a method for designing the outer diameter of the scroll housing 12 using the Archimedean scroll curve (A) will be described. The scroll housing 12 has a structure such that the radius ($R_\theta$) of curvature of the scroll housing 12 is proportionate to angles ($\theta$) based on a mean velocity formula when the radius ($R_0$) of the impeller 11 is determined. In case that the expansion angle of the scroll housing 12 is represented by $\alpha$, the radius ($R_\theta$) of curvature of the scroll housing 12 at a designated angle ($\theta_x$) is calculated by The Equations below.

$$\tan(\alpha) = \left(\frac{R_\theta - (R_0 + C_C)}{2\pi(R_0 + C_C)\left(\frac{\theta_x - \theta_c}{360}\right)}\right)$$

$$R_\theta = (R_0 + C_C) + \tan(\alpha)\left(2\pi(R_0 + C_C)\left(\frac{\theta_x - \theta_c}{360}\right)\right)$$

$$R_\theta = (R_0 + C_C) + \left(1 + \tan(\alpha)\pi\left(\frac{\theta_x - \theta_c}{180}\right)\right)$$

Here, $R_0$ represents the radius (mm) of the impeller 11, $\theta_x$ represents a designated angle (°), $C_C$ represents the cleavage (mm) of the cutoff portion, and $\theta_c$ represents the position angle (°) of the cutoff portion.

Thereafter, with reference to FIG. 4, a method for designing the outer diameter of the scroll housing 12 using the exponential scroll curve (E) will be described. The scroll housing 12 has a structure such that the radius ($R_\theta$) of curvature of the scroll housing 12 is exponentially increased based on a free vortex formula. In case that the expansion angle of the scroll housing 12 is represented by $\alpha$, the radius ($R_\theta$) of curvature of the scroll housing 12 at a designated angle ($\theta_x$) is calculated by the Equation below.

$$R_\theta = (R_0 + C_C) \times e^{\left(\tan(\alpha)\pi\frac{\theta_x - \theta_c}{180}\right)}$$

Here, in the Archimedean scroll curve (A) as shown in FIG. 2, the width (W) of the scroll housing 12 is the sum total of the width (w180) of the scroll housing 12 when the radius ($R_\theta$) of curvature thereof is 180° and the width (w360) of the scroll housing 12 when the radius ($R_\theta$) of curvature thereof is 360°. Accordingly, when the radius ($R_0$) of the impeller 11 is determined and the width (W) of the scroll housing 12 is constant, the expansion angle ($\alpha$) of the scroll housing 12 is restricted by the above-described Equations.

That is, in case that the radius ($R_0$) of the impeller 11 is set to 40 mm, the cleavage ($C_C$) of the cutoff portion is set to 5 mm, the position angle ($\theta_c$) of the cutoff portion is set to 90°, and the width (W) of the scroll housing 12 is set to 115 mm, the maximum expansion angle ($\alpha$) of the scroll housing 12 designed using the Archimedean scroll curve (A) is 5.053°, w180 is 51.2501 mm, and w360 is 63.7503 mm.

On the other hand, the maximum expansion angle ($\alpha$) of the scroll housing 12 designed using the exponential scroll curve (E) is 4.3334°, w180 is 50.6882 mm, and w360 is 64.3123 mm.

Since the maximum expansion angle ($\alpha$) of the scroll housing 12 of the conventional centrifugal fan is constant when the radius ($R_0$) of the impeller 11 and the cleavage ($C_C$) of the cutoff portion are determined and the width (W) of the scroll housing 12 is constant, the radius ($R_0$) of the impeller 11 and the cleavage ($C_C$) of the cutoff portion of the scroll housing 12 of the conventional centrifugal fan must be reduced in order to increase the expansion angle ($\alpha$), which affects the flow rate. However, this design causes problems, such as the reduction of blast capacity and the increase of noise.

SUMMARY OF THE INVENTION

Therefore, the present invention has been made in view of the above problems, and it is an object of the present invention to provide a centrifugal fan, in which an expansion angle of a radius of curvature of the outer periphery of a scroll housing from a position angle of a cutoff portion to a designated portion is gradually decreased, and an expansion angle of the radius of curvature of the outer periphery of the scroll housing from the above designated portion to a discharge portion is gradually increased, thereby improving blast capacity and reducing noise.

In accordance with one aspect of the present invention, the above and other objects can be accomplished by the provision of a centrifugal fan, wherein: an expansion angle of a radius of curvature of the outer periphery of a scroll housing from a position angle of a cutoff portion, serving as a suction portion, to a designated portion from the former in the direction of air flow is gradually decreased; and an expansion angle of the radius of curvature of the outer periphery of the scroll housing from the above designated portion to a discharge portion is gradually increased.

Preferably, the region having the decreased expansion angle may be set from the position angle of the cutoff portion to the position at an angle of 180°±10° from a reference angle ($\theta_0$), where a curved surface of the outer periphery of the scroll housing is finished.

Preferably, the increased expansion angle may be set to be the same as an expansion angle determined by an Archimedean scroll curve, or to be larger than the expansion angle determined by the Archimedean scroll curve.

Further, preferably, the increased expansion angle may be set to be the same as an expansion angle determined by an exponential scroll curve.

In accordance with another aspect of the present invention, there is provided a centrifugal fan, wherein an expansion angle of a radius of curvature of the outer periphery of a scroll housing from a position angle of a cutoff portion, serving as a suction portion, to a designated portion from the former in the direction of air flow is gradually decreased.

Since the centrifugal fan of the present invention, in which the expansion angle in a suction region, which little affects flow rate and noise, is gradually decreased and the expansion angle in a discharge region is gradually increased, the centrifugal fan assures the maximum discharge route, thereby increasing the flow rate generated by the easy conversion from the velocity of the discharged fluid to pressure due to the increased dimensions of the discharge region. Further, noise generated from a cutoff portion of the centrifugal fan of the present invention maintains the same level as that of the conventional centrifugal fan, thereby reducing noise at the same flow rate.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the annexed drawings.

Although the present invention can include several embodiments of a centrifugal fan, only the most preferred embodiment of the centrifugal fan will be described below. The fundamental structure of the centrifugal fan is the same as that of the conventional centrifugal fan, and the detailed description thereof will be thus omitted.

Figure 1:
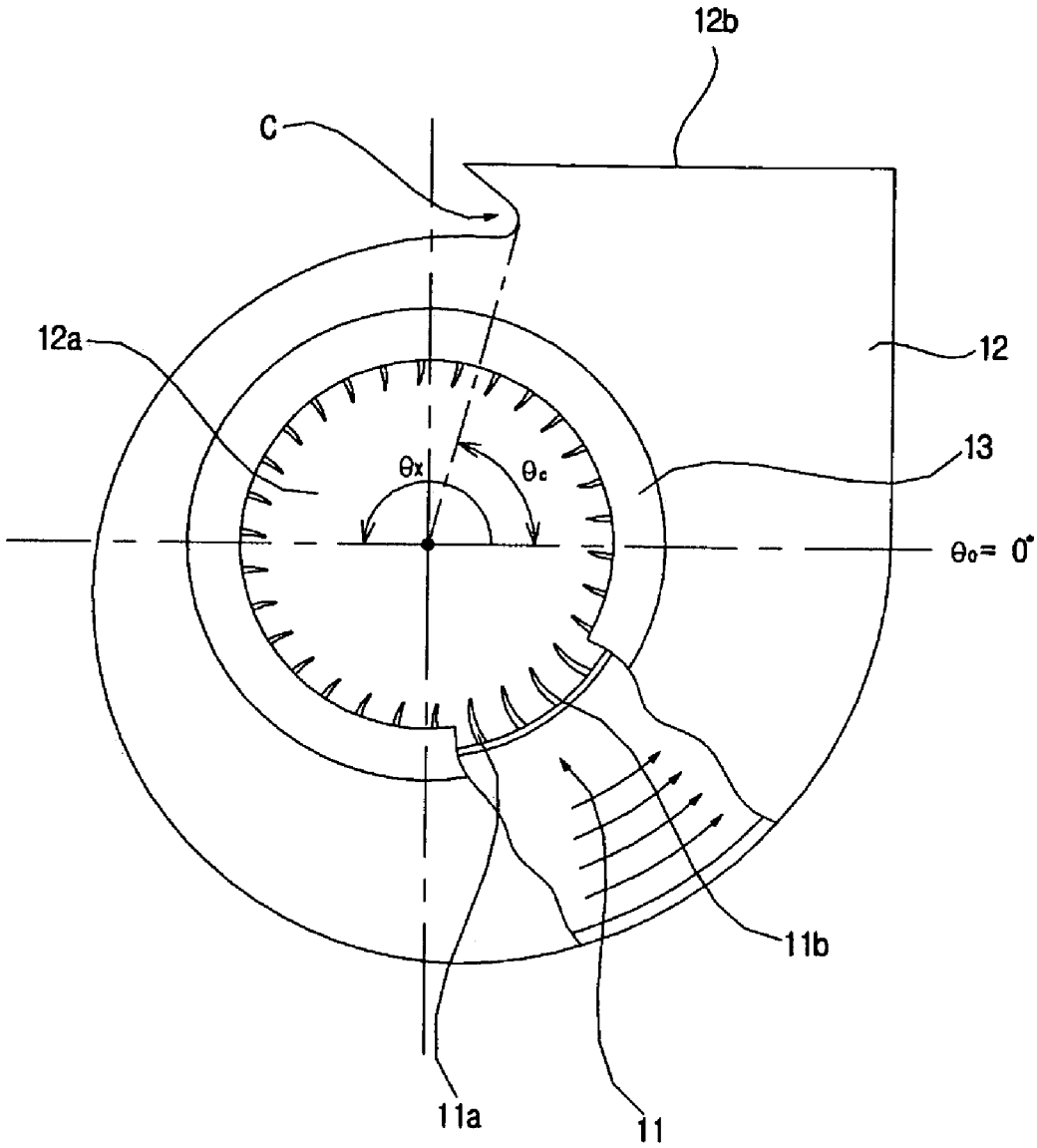
FIG. 1 (Prior Art)
FIG. 1 is a schematic front view of a conventional centrifugal fan.
Figure 2:
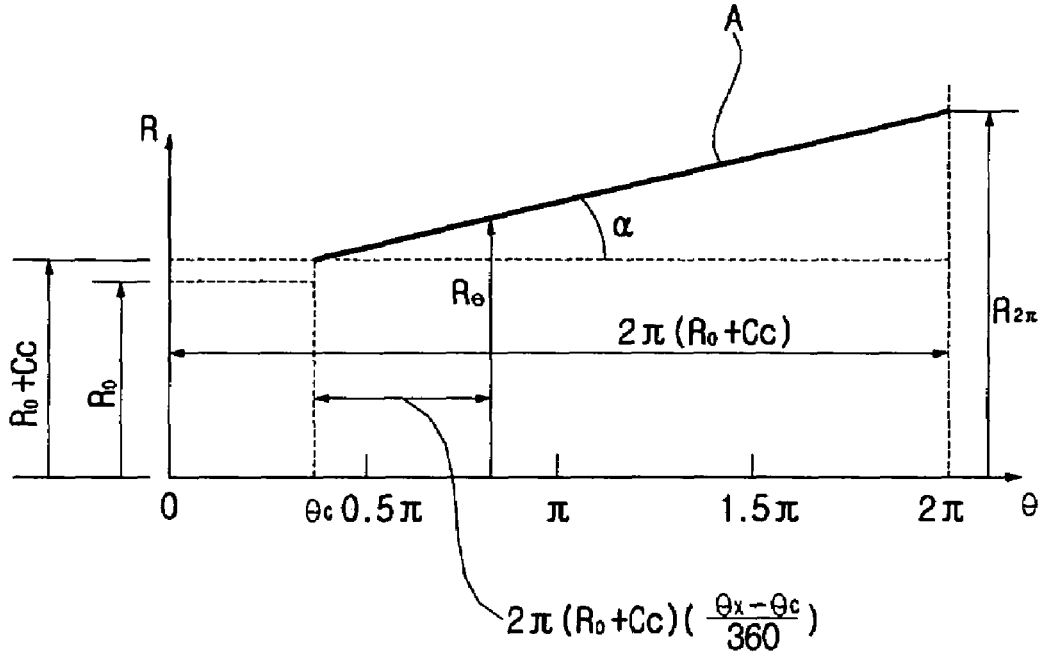
FIG. 2 (Prior Art)
FIG. 2 is a graph illustrating an expansion angle of a conventional centrifugal fan, a scroll housing of which is designed using an Archimedean scroll curve.
Figure 3:
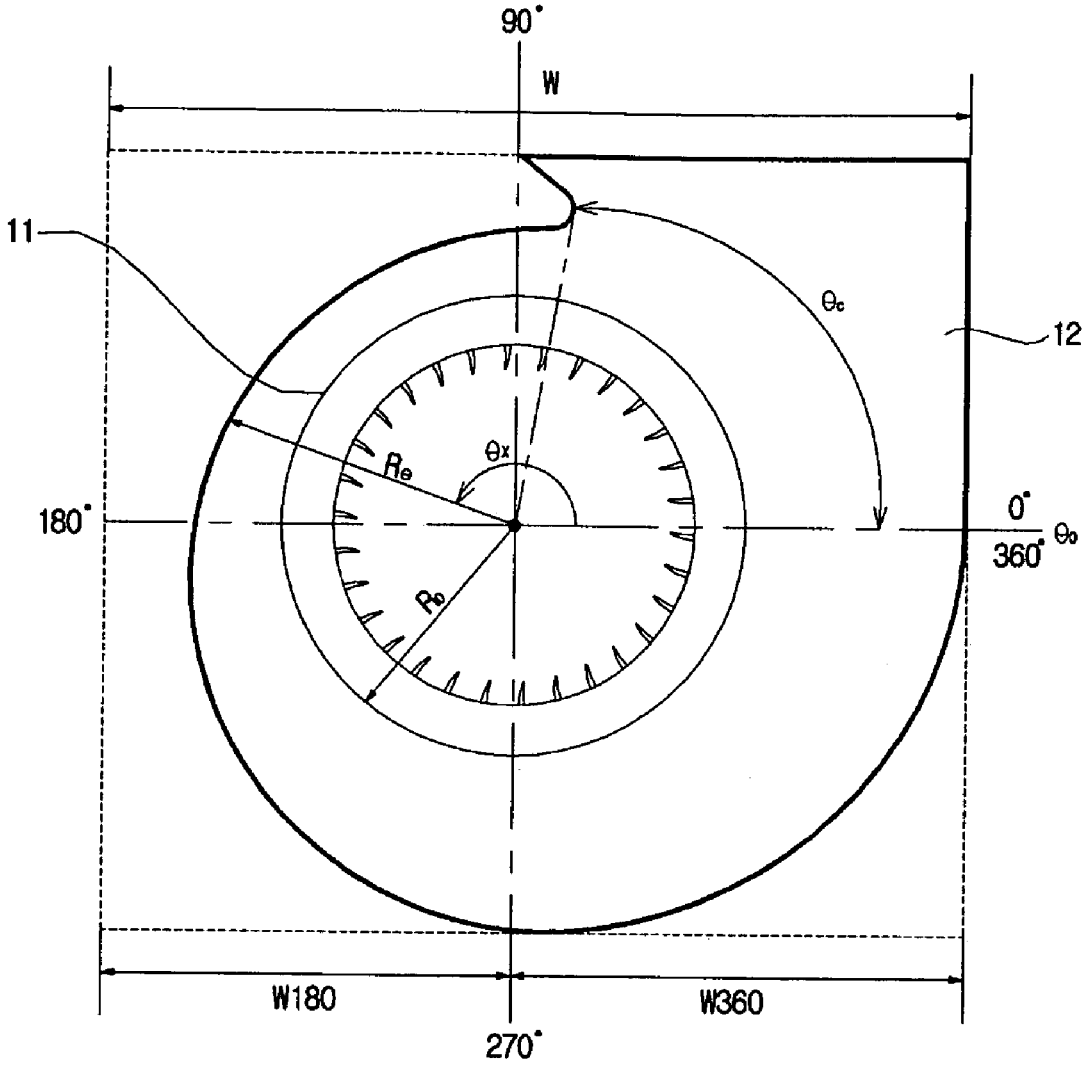
FIG. 3 (Prior Art)
FIG. 3 is a schematic front view of the conventional centrifugal fan, the scroll housing of which is designed using the Archimedean scroll curve.
Figure 4:
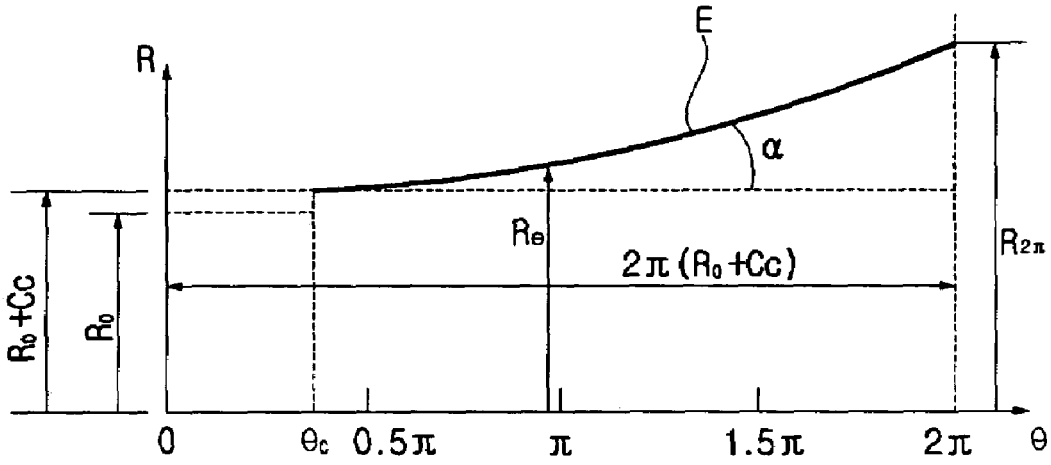
FIG. 4 (Prior Art)
FIG. 4 is a graph illustrating an expansion angle of another conventional centrifugal fan, a scroll housing of which is designed using an exponential scroll curve.
Figure 5:
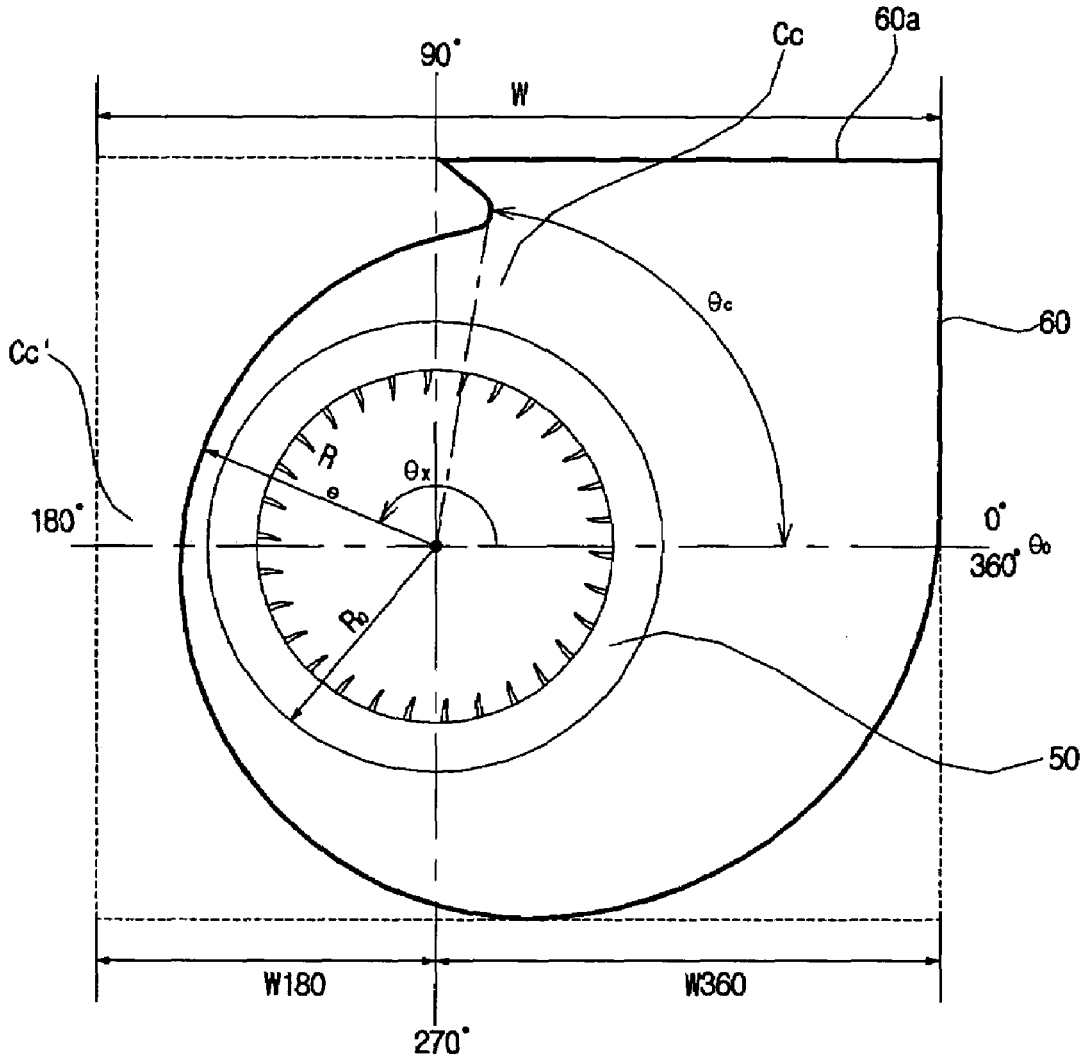
FIG. 5 is a schematic front view of a centrifugal fan, a scroll housing of which is designed in accordance with the present invention.
Figure 6:
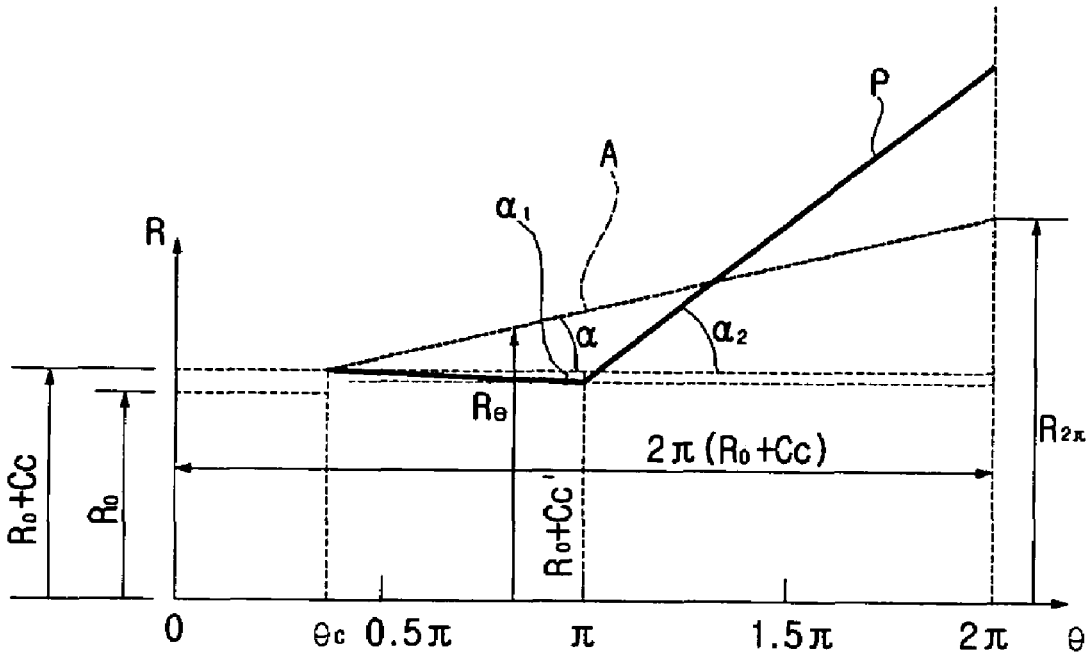
FIG. 6 is a graph illustrating expansion angles of the centrifugal fan, the scroll housing of which is designed in accordance with the present invention, and the conventional centrifugal fan, the scroll housing of which is designed using the Archimedean scroll curve.

FIG. 5 is a schematic front view of a centrifugal fan, a scroll housing of which is designed in accordance with the present invention. FIG. 6 is a graph illustrating expansion angles of the centrifugal fan, the scroll housing of which is designed in accordance with the present invention, and the conventional centrifugal fan, the scroll housing of which is designed using the Archimedean scroll curve.

As shown in FIGS. 5 and 6, the centrifugal fan in accordance with the present invention comprises an impeller 50 rotated by a motor, and a scroll housing 60 for guiding air inhaled by the impeller 50 to an outlet 60*a* and discharging the air to the outside through the outlet 60*a*.

Particularly, when a designated angle ($\theta_x$) is set from the reference angle ($\theta_0$) at the portion, where the curved surface forming the outer periphery of the scroll housing 60 is finished, along the direction of air flow, a curve (P) forming the outer periphery of the scroll housing 60 differently varies expansion angles ($\alpha_1$ and $\alpha_2$) according to the angle ($\theta_x$). More specifically, the expansion angle ($\alpha_1$) of the radius of curvature ($R_\theta$) of the outer periphery of the scroll housing 60 from the position angle ($\theta_c$) of the cutoff portion, serving as a suction portion, to a designated portion from the former in a direction of the rotation of the impeller 50 is gradually decreased, and the expansion angle ($\alpha_2$) of the radius of curvature ($R_\theta$) of the outer periphery of the scroll housing 60 from the designated portion to a discharge portion is gradually increased.

That is, in the curve (P) forming the outer periphery of the scroll housing 60, the decreased expansion angle ($\alpha_1$) is set to a region from the position angle ($\theta_c$) of the cutoff portion, where the curved surface forming the outer periphery of the scroll housing 60 is finished, to the position at an angle of 180°±10° from the reference angle ($\theta_0$), and the increased expansion angle ($\alpha_2$) is set to be the same as an expansion angle determined by the Archimedean scroll curve (A) or the exponential scroll curve (E), or to be larger than the expansion angle (a) determined by the Archimedean scroll curve (A) shown in FIG. 6.

Accordingly, since the expansion angle ($\alpha_1$) of the scroll housing 60 from the position angle of ($\theta_c$) of the cutoff portion to the position at an angle of approximately 180° from the reference angle ($\theta_0$) is gradually decreased under the condition that the impeller 50 of the centrifugal fan of the present invention is designed such that the impeller 50 has the same radius at any portions, the cleavage ($C_C$), between the outer diameter of the impeller 50 and the curved surface of the scroll housing 60 at the cutoff portion, is the largest and the cleavage ($C_{C'}$), between the outer diameter of the impeller 50 and the curved surface of the scroll housing 60 at the portion at the angle of approximately 180° from the reference angle ($\theta_0$), is the smallest. Further, since the expansion angle ($\alpha_2$) of the scroll housing 60 in the region at an angle of 180°~360° is set to be larger than the expansion angle ($\alpha$) determined by the Archimedean scroll curve (A), the slope of the expansion angle ($\alpha_2$) is rapidly increased as shown in FIG. 6.

The Table below comparatively states the radiuses of curvature of the outer periphery of the scroll housing designed by the Archimedean scroll curve (A) and the exponential scroll curve (E) and the radius of curvature of the outer periphery of the scroll housing designed by the curve (P) of the present invention.

| Angle | Archimedean (A) | Exponential (E) | Present invention (P) |
|---|---|---|---|
| 90 | 45 | 45 | 45 |
| 95 | 45.3472 | 45.2986 | 44.88889 |
| 100 | 45.6945 | 45.5991 | 44.77778 |
| 105 | 46.0417 | 45.9016 | 44.66667 |
| 110 | 46.3889 | 46.2062 | 44.55556 |
| 115 | 46.7361 | 46.5127 | 44.44444 |
| 120 | 47.0834 | 46.8213 | 44.33333 |
| 125 | 47.4306 | 47.132 | 44.22222 |
| 130 | 47.7778 | 47.4447 | 44.11111 |
| 135 | 48.1251 | 47.7595 | 44 |
| 140 | 48.4723 | 48.0763 | 43.88889 |
| 145 | 48.8195 | 48.3953 | 43.77778 |
| 150 | 49.1667 | 48.7164 | 43.66667 |
| 155 | 49.514 | 49.0396 | 43.55556 |
| 160 | 49.8612 | 49.365 | 43.44444 |
| 165 | 50.2084 | 49.6925 | 43.33333 |
| 170 | 50.5556 | 50.0222 | 43.22222 |
| 175 | 50.9029 | 50.3541 | 43.11111 |
| 180 | 51.2501 | 50.6882 | 43 |
| 185 | 51.5973 | 51.0244 | 43.8056 |
| 190 | 51.9446 | 51.363 | 44.6111 |
| 195 | 52.2918 | 51.7038 | 45.4167 |
| 200 | 52.639 | 52.0468 | 46.2222 |
| 205 | 52.9862 | 52.3921 | 47.0278 |
| 210 | 53.3335 | 52.7397 | 47.8333 |
| 215 | 53.6807 | 53.0896 | 48.6389 |
| 220 | 54.0279 | 53.4419 | 49.4444 |
| 225 | 54.3752 | 53.7964 | 50.25 |
| 230 | 54.7224 | 54.1533 | 51.0555 |
| 235 | 55.0696 | 54.5126 | 51.8611 |
| 240 | 55.4168 | 54.8743 | 52.6666 |
| 245 | 55.7641 | 55.2384 | 53.4722 |
| 250 | 56.1113 | 55.6049 | 54.2777 |
| 255 | 56.4585 | 55.9738 | 55.0833 |
| 260 | 56.8057 | 56.3452 | 55.8889 |
| 265 | 57.153 | 56.719 | 56.6944 |
| 270 | 57.5002 | 57.0953 | 57.5 |
| 275 | 57.8474 | 57.4741 | 58.3055 |
| 280 | 58.1947 | 57.8554 | 59.1111 |
| 285 | 58.5419 | 58.2393 | 59.9166 |
| 290 | 58.8891 | 58.6257 | 60.7222 |
| 295 | 59.2363 | 59.0146 | 61.5277 |
| 300 | 59.5836 | 59.4062 | 62.3333 |
| 305 | 59.9308 | 59.8003 | 63.1388 |
| 310 | 60.278 | 60.1971 | 63.9444 |
| 315 | 60.6253 | 60.5965 | 64.7499 |
| 320 | 60.9725 | 60.9985 | 65.5555 |
| 325 | 61.3197 | 61.4032 | 66.361 |
| 330 | 61.6669 | 61.8106 | 67.1666 |
| 335 | 62.0142 | 62.2227 | 67.9722 |
| 340 | 62.3614 | 62.6335 | 68.7777 |
| 345 | 62.7086 | 63.0491 | 69.5833 |

-continued

| Angle | Archimedean (A) | Exponential (E) | Present invention (P) |
|---|---|---|---|
| 350 | 63.0558 | 63.4674 | 70.3888 |
| 355 | 63.4031 | 63.8885 | 71.1944 |
| 360 | 63.7503 | 64.3123 | 71.9999 |

The width (W) of the scroll housing 60 is the sum total of the width (w180) of the scroll housing 60 when the radius ($R_\theta$) of curvature thereof is 180° and the width (w360) of the scroll housing 60 when the radius ($R_\theta$) of curvature thereof is 360°. Accordingly, when the radius ($R_0$) of the impeller 50 is determined and the width (W) of the scroll housing 60 is constant, the radius ($R_\theta$) of curvature of the scroll housing 60 is designed as stated in the Table above.

Here, in case that the radius ($R_0$) of the impeller 50 is set to 40 mm, the cleavage ($C_C$) of the cutoff portion is set to 5 mm, the position angle ($\theta_c$) of the cutoff portion is set to 90°, the width (W) of the scroll housing 60 is set to 115 mm, and the cleavage ($C_{C''}$) of the portion at the angle of approximately 180° from the reference angle ($\theta_0$) is set to 3 mm, when the expansion angle ($\alpha_2$) of the curve (P) reaches 12.116°, twice or more as large as the expansion angle ($\alpha$), i.e., 5.053°, of the conventional Archimedean scroll curve (A), the width (w180) is 43 mm and the width (w360) is 72 mm.

In case that the width (W) of the scroll housing 60 is restricted as described above, the radius ($R_0$) of the impeller 50 is the same, and the expansion angle ($\alpha_1$) is decreased and then the expansion angle ($\alpha_2$) is increased. Here, the radius of the scroll housing 60 of the centrifugal fan of the present invention at the discharge region in the range of the angle of 270°~360° is increased to be larger than the radius of the scroll housing of the conventional centrifugal fan, thereby reducing the dimensions of a region generating air flow loss in the scroll housing 60 caused by a flow rate increasing effect due to the increased expansion angle. Further, since noise generated at the cutoff portion of the scroll housing 60 of the centrifugal fan of the present invention has the same level as that of the conventional centrifugal fan, thereby reducing noise at the same flow rate.

Figure 7:
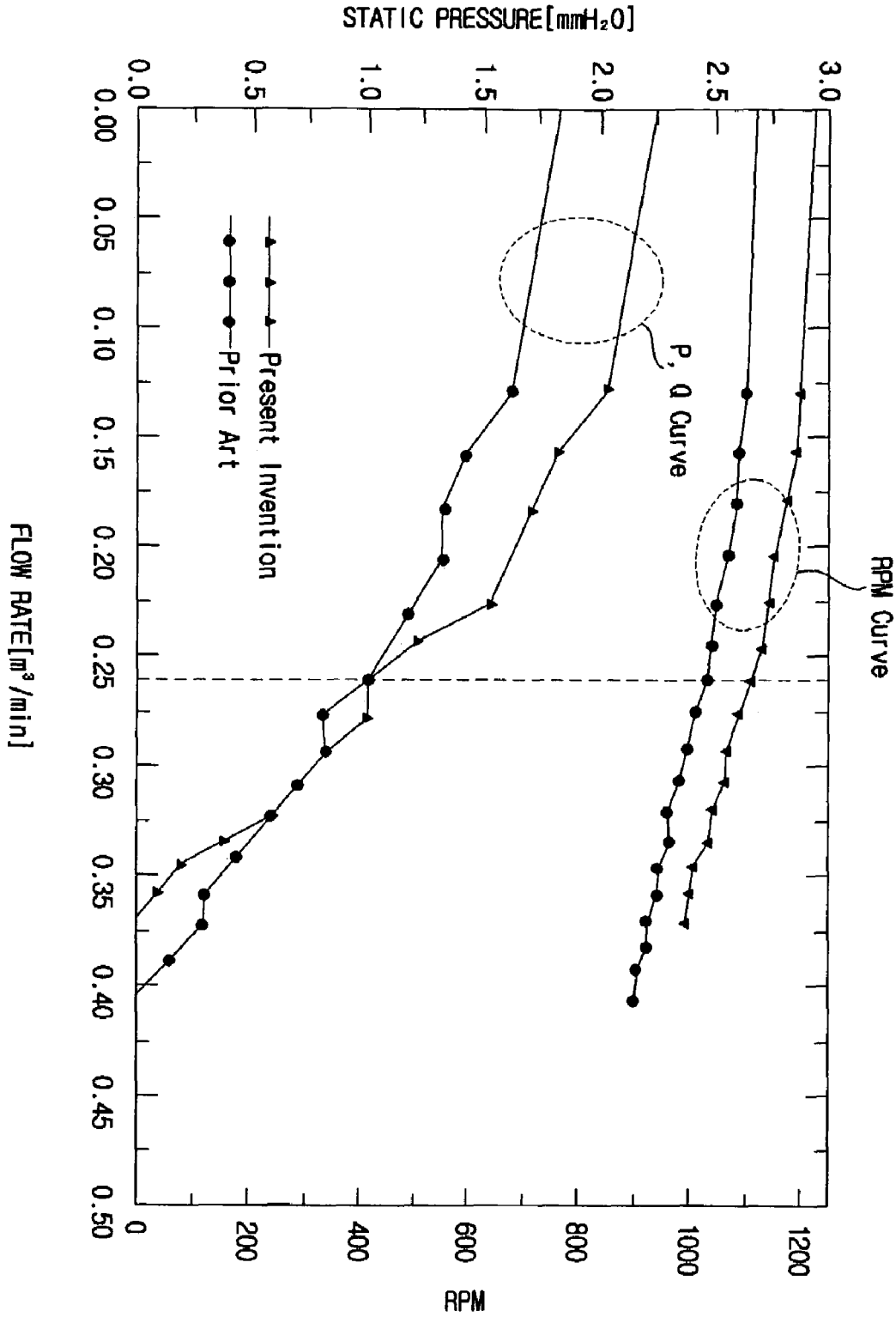
FIG. 7 is a graph comparatively illustrating static pressures, flow rates, and rotational speeds of the centrifugal fan of the present invention and the conventional centrifugal fan.

FIG. 7 is a graph comparatively illustrating static pressures, flow rates, and rotational speeds of the centrifugal fan of the present invention and the conventional centrifugal fan. In case that the centrifugal fan of the present invention and the conventional centrifugal fan use the same impeller 50, the centrifugal fan of the present invention has the increased flow rate (when a static pressure ($P_s$) is zero (0)) compared to that of the conventional centrifugal fan. However, at an operating point (P), the flaw rates of the two centrifugal fan are the same but the rotational speeds (rpm) of the impeller of the centrifugal fan of the present invention is decreased compared to that of the conventional centrifugal fan. Thereby, it is understood that noise of the centrifugal fan of the present invention is remarkably lower than that of the conventional centrifugal fan at the same flow rate.

As apparent from the above description, the present invention provides a centrifugal fan, in which an expansion angle in a suction region, having little effect on flow rate and noise, is gradually decreased and an expansion angle in a discharge region is gradually increased, to assure the maximum discharge route, thereby increasing the flow rate generated by the easy conversion from the velocity of the discharged fluid to pressure due to the increased dimensions of the discharge region. Further, since noise generated from a cutoff portion of the centrifugal fan of the present invention maintains the same level as that of the conventional centrifugal fan, the centrifugal fan of the present invention has reduced noise at the same flow rate.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A centrifugal fan, comprising:

an impeller; and a housing having a curved portion with a radius of curvature, defined as a distance between a rotational axis of the impeller and the housing, wherein the radius of curvature decreases, in a direction of rotation of the impeller, from a first end of the curved portion of the housing to a single point where the radius of curvature is a minimum, the radius of curvature increases, in the direction of rotation of the impeller, from the point where the radius of curvature is the minimum to a second end of the curved portion of the housing, a gap exists between an outer circumference of the impeller and the housing at the point where the radius of curvature is a minimum, a cutoff portion is formed at the first end of the curved portion of the housing, and the point where the radius of curvature is a minimum is located approximately 170° to 190° from the second end of the curved portion of the housing.

2. The centrifugal fan according to claim 1, wherein the radius of curvature of the housing between the point where the radius of curvature is the minimum and the second end of the curved portion of the housing substantially corresponds to an Archimedean scroll curve.

3. The centrifugal fan according to claim 1, wherein the radius of curvature of the housing between the point where the radius of curvature is the minimum and the second end of the curved portion of the housing increases at a rate greater than an Archimedean scroll curve.

4. A centrifugal fan, comprising:

an impeller; and a housing having a curved portion with a radius of curvature, defined as a distance between a rotational axis of the impeller and the housing, wherein the radius of curvature decreases, in a direction of rotation of the impeller, from a first end of the curved portion of the housing to a single point where the radius of curvature is a minimum, the radius of curvature increases, in a direction of rotation of the impeller, from the point where the radius of curvature is the minimum to a second end of the curved portion of the housing, the radius of curvature of the housing at the second end of the curved portion is approximately one and two-thirds times larger than the minimum radius of curvature of the housing, a cutoff portion is formed at the first end of the curved portion of the housing, and the point where the radius of curvature is a minimum is located approximately 170° to 190° from the second end of the curved portion of the housing.

5. The centrifugal fan according to claim 4, wherein the radius of curvature of the housing between the point where the radius of curvature is the minimum and the second end of the curved portion of the housing substantially corresponds to an Archimedean scroll curve.

6. The centrifugal fan according to claim 4, wherein the radius of curvature of the housing between the point where the radius of curvature is the minimum and the second end of the curved portion of the housing increases at a rate greater than an Archimedean scroll curve.

* * * * *